US009488453B2

(12) United States Patent
Dikhoff et al.

(10) Patent No.: US 9,488,453 B2
(45) Date of Patent: Nov. 8, 2016

(54) STRUCTURING OF THE OGIVE SURFACE OF A PROJECTILE

(75) Inventors: Hannes Dikhoff, Oberasbach (DE); Karlheinz Muss, Höchstadt (DE); Vasile Papet, Fürth (DE); Frank Mönius, Cadolzburg (DE)

(73) Assignee: Ruag Ammotec GmbH, Furth (DE)

( * ) Notice: Subject to any disclaimer, the term of this patent is extended or adjusted under 35 U.S.C. 154(b) by 0 days.

(21) Appl. No.: 14/237,639

(22) PCT Filed: Aug. 7, 2012

(86) PCT No.: PCT/EP2012/065435

§ 371 (c)(1),
(2), (4) Date: Feb. 7, 2014

(87) PCT Pub. No.: WO2013/020976

PCT Pub. Date: Feb. 14, 2013

(65) Prior Publication Data

US 2014/0318405 A1 Oct. 30, 2014

(30) Foreign Application Priority Data

Aug. 8, 2011 (DE) ..... 10 2011 109 666

(51) Int. Cl.

| | |
|---|---|
| ***F42B 5/24*** | (2006.01) |
| ***F42B 12/02*** | (2006.01) |
| ***F42B 10/38*** | (2006.01) |
| ***F42B 10/42*** | (2006.01) |

(52) U.S. Cl.

CPC ..... *F42B 12/02* (2013.01); *F42B 10/38* (2013.01); *F42B 10/42* (2013.01)

(58) Field of Classification Search

USPC ..... 102/501, 507, 509, 517, 502

See application file for complete search history.

(56) References Cited

U.S. PATENT DOCUMENTS

| | | | | | |
|---|---|---|---|---|---|
| 871,825 | A * | 11/1907 | Schupmann | ..... | 102/501 |
| 1,099,298 | A * | 6/1914 | Hoagland | ..... | 102/507 |
| 1,181,849 | A * | 5/1916 | Coomber | ..... | 244/3.23 |
| 3,349,711 | A * | 10/1967 | Julius Darigo et al. | ..... | 102/509 |
| 4,063,512 | A * | 12/1977 | Davis | ..... | 102/476 |
| 4,173,930 | A * | 11/1979 | Faires, Jr. | ..... | 102/448 |
| 4,702,170 | A * | 10/1987 | Trudeau | ..... | 102/446 |
| 4,718,348 | A * | 1/1988 | Ferrigno | ..... | 102/439 |
| 4,867,065 | A * | 9/1989 | Kaltmann et al. | ..... | 102/444 |
| 4,996,924 | A * | 3/1991 | McClain | ..... | 102/501 |
| 5,164,538 | A * | 11/1992 | McClain III | ..... | 102/517 |
| 5,200,573 | A * | 4/1993 | Blood | ..... | 102/501 |
| 5,208,424 | A * | 5/1993 | Schluckebier et al. | ..... | 102/509 |
| 5,356,150 | A * | 10/1994 | Lavallee et al. | ..... | 473/383 |
| 5,378,524 | A * | 1/1995 | Blood | ..... | 428/141 |
| 5,544,398 | A * | 8/1996 | Corzine et al. | ..... | 86/55 |
| 5,890,975 | A * | 4/1999 | Stiefel | ..... | 473/384 |
| 6,640,722 | B2 * | 11/2003 | Stogermuller | ..... | 102/439 |
| 7,127,996 | B2 * | 10/2006 | Muth | ..... | 102/516 |
| 7,350,465 | B2 * | 4/2008 | Keegstra et al. | ..... | 102/502 |
| 8,789,470 | B2 * | 7/2014 | Frank | ..... | 102/509 |

(Continued)

*Primary Examiner* — Michelle R Clement

(74) *Attorney, Agent, or Firm* — Fitch, Even, Tabin and Flannery LLP

(57) ABSTRACT

The invention relates to a projectile with a projectile tip (9) at the front as viewed in the direction of the shot, which transforms via an ogive (1) into a rear cylindrical area (7). To reduce the air resistance and optimize precision, it is proposed according to the invention that the surface of the ogive (1) be structured.

19 Claims, 2 Drawing Sheets

(56) References Cited

U.S. PATENT DOCUMENTS

Figure 1:
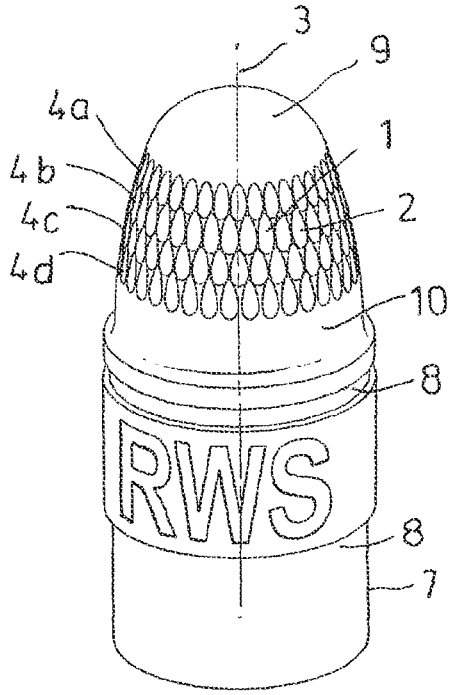

| | | | | |
|---|---|---|---|---|
| 2004/0244629 | A1* | 12/2004 | Jopson | 102/508 |
| 2006/0005731 | A1* | 1/2006 | Muth | 102/501 |
| 2009/0151593 | A1* | 6/2009 | Winter | 102/521 |
| 2010/0058948 | A1* | 3/2010 | Dehaan et al. | 102/502 |
| 2012/0073465 | A1* | 3/2012 | Scarr | 102/502 |
| 2012/0111220 | A1* | 5/2012 | King | 102/509 |
| 2012/0210903 | A1* | 8/2012 | Wilson | 102/444 |
| 2012/0216700 | A1* | 8/2012 | Dennison | 102/514 |
| 2014/0235380 | A1* | 8/2014 | Martino | 473/613 |

* cited by examiner

STRUCTURING OF THE OGIVE SURFACE OF A PROJECTILE

The invention relates to a projectile having a projectile tip at the front, as seen in the direction of firing, which develops into a rear cylindrical area by way of an ogive.

Cartridges of the .22 LR caliber currently have a projectile with an ogive, whose surface is designed to be smooth without exception. The shape of the ogive represents an attempt to improve the trajectory properties of the projectile.

The object of the invention is to develop a projectile according to the preamble of claim 1, which will have a lower air resistance and an optimized precision.

This object is achieved according to the invention by the fact that the surface of the ogive is structured. It has surprisingly been found that even minor structuring of the surface will reduce the air resistance and optimize the precision of the projectile.

In a preferred embodiment, the surface has recesses. Recesses are easily created.

In a preferred embodiment, the recesses are droplet-shaped. The special droplet shape of the recesses on the ogive produces positive changes in the air resistance of the projectile. This leads to an elongated and more uniform trajectory and thus improves the precision.

The recesses are preferably arranged on circles, which encompass the ogive and are arranged perpendicular to the longitudinal axis of the projectile, wherein the recesses are preferably arranged so they abut against one another on the circles. The recesses are then arranged so that the resulting air turbulence is added and subtracted, so that an optimal flow resistance coefficient $C_w$ value is achieved.

This situation can be further improved if the recesses are arranged so they are also on a circle in relation to the recesses on a neighboring circle, so that one recess is arranged on the circle between two recesses on a neighboring circle.

This can be further improved if the recesses on one circle are arranged so they are offset from the recesses on a neighboring circle, so that a recess on one circle is arranged between two recesses on a neighboring circle.

The optimum approach is when the recesses on one circle are arranged with an offset from the recesses on the neighboring circle, amounting to half the diameter of one recesses. This embodiment is illustrated in the figures, which are described below.

Four circles are preferably provided on the ogive.

In a preferred embodiment, peripheral grooves running parallel to the circles are arranged on the cylindrical area beneath the recesses in the direction away from the tip of the projectile. The grooves in the cylindrical area have the task of optimally deflecting the air stream, which is generated by the droplet-shaped recesses around the projectile. The projectile is therefore also much less sensitive to weather influences such as wind and rain or snow.

In a preferred embodiment, the surface of the tip of the projectile is designed to be smooth, and a calming zone is arranged beneath the recesses in the direction away from the tip of the projectile as far as the grooves, where the surface of this calming zone is smooth. Turbulence develops in these regions. There is a calming effect on the air flow due to their smooth surfaces.

The use of the projectile according to the invention for cartridges of the caliber .22 LR is preferred, in particular for rim-fire cartridges.

Figure 2A:
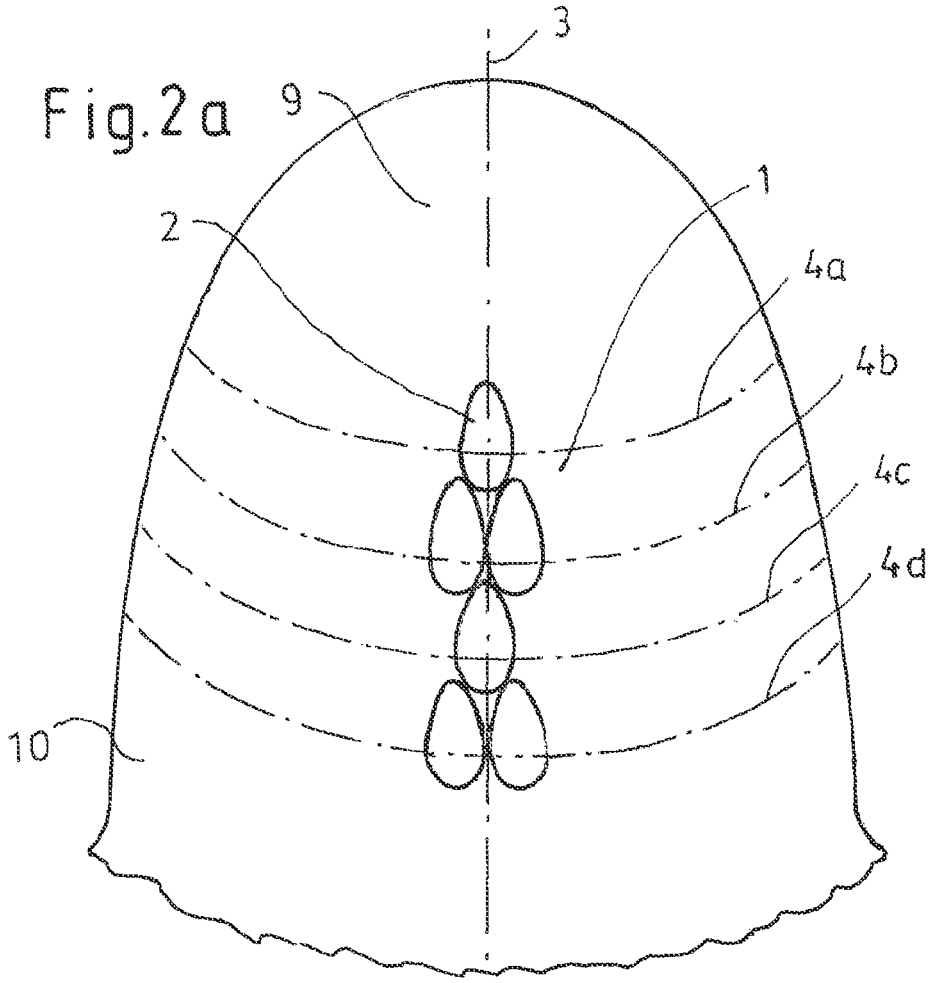
Figure 2B:
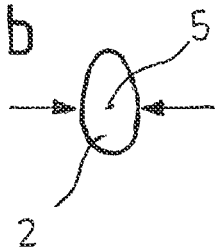

The invention is explained in greater detail below on the basis of two figures, in which FIG. 1 shows a projectile according to the invention, FIG. 2*a* shows schematically circles on the ogive of the projectile on which recesses are arranged, and FIG. 2*b* shows the diameter of a recess.

FIG. 1 shows a projectile according to the invention having a projectile tip 9, which develops into a cylindrical region 7 by way of an ogive 1. Recesses 2 are arranged on the surface of the ogive as structuring.

These recesses 2 are droplet shaped, so that the largest diameter 5 is in the lower half of the droplet shape, i.e., it is situated away from the projectile tip 9. Starting from the tip of the droplet, which points in the direction of the projectile tip 9, the diameter of the droplet shape increases steadily up to the largest diameter 5 and then decreases steadily.

These recesses 2 are arranged on circles 4*a*, 4*b*, 4*c*, 4*d* (see FIGS. 2*a* and 2*b* in this regard), which encompass the ogive 1 and are arranged at a right angle to the longitudinal axis 3 of the projectile. Recesses 2 in the embodiment shown here are arranged so they abut against one another on these circles 4*a*, 4*b*, 4*c*, 4*d*. The recesses 2 are arranged on a circle 4*b* with an offset in relation to the recesses 2 on a neighboring circle 4*a* or 4*c*, so that a recess 2 on a circle 4*a*, 4*b*, 4*c*, 4*d* is arranged between two recesses 2 on a neighboring circle 4*a*, 4*b*, 4*c*, 4*d*. The recesses 2 on a circle 4*a*, 4*b*, 4*c*, 4*d* are preferably arranged with an offset from the recesses 2 on the neighboring circle 4*a*, 4*b*, 4*c*, 4*d*, so the offset amounts to half of the diameter 5 (see FIG. 2*b*) of a recess 2. The diameter 5 of the recess 2 refers to the width of the recess 2 on the surface.

FIG. 2*a* shows schematically the circles 4*a*, 4*b*, 4*c*, 4*d* on the ogive 1 on which the recesses 2 are arranged. It can be seen here well that the recesses 2 are arranged on a circle 4*a*, 4*b*, 4*c*, 4*d*, so that they are offset radially from the recesses 2 on the neighboring circle 4*a*, 4*b*, 4*c*, 4*d*. The recesses 2 in FIG. 2*a* have a droplet-shaped design.

Grooves 8 running parallel to the circles 4*a*, 4*b*, 4*c*, 4*d* are arranged on the cylindrical region 7 below the recesses 2 in the direction away from the projectile tip 9.

The air resistance of the basic projectile is altered in a positive sense due to the special droplet shape of the recesses 2 on the ogive 1 of the projectile. This leads to an elongated and more uniform trajectory and therefore improved precision. The recesses 2 are arranged in such a way that the resulting turbulence can be added and subtracted, thus achieving an optimal $C_w$ value.

The grooves 8 situated in the cylindrical region 7 are designed so that they optimally deflect the air stream, which is created due to the droplet-shaped recesses 2, around the projectile. This makes the projectile much less sensitive to weather influences such as wind or rain and snow.

The region in which the turbulence occurs is defined so that the projectile tip 9 is smooth, i.e., it has no recesses there and there is a calming zone 10 between the recesses 2 and the grooves 8, having a smooth surface and contributing toward the calming of the air flow.

The invention claimed is:

1. A projectile with a projectile tip at the front as seen in the direction of firing, developing into a rear cylindrical region by way of an ogive, characterized in that the surface of the ogive is structured in the form of recesses having a droplet shape, the recesses being arranged so they abut against one another on circles which encompass the ogive and which are arranged at a right angle to the longitudinal axis of the projectile.

2. The projectile according to claim 1, characterized in that the recesses on one circle are arranged with an offset from the recesses on a neighboring circle, so that a recess on one circle is arranged between two recesses on a neighboring circle.

3. The projectile according to claim 2, characterized in that the recesses are one circle are arranged with an offset from the recesses on the neighboring circle amounting to half of the diameter of a recess.

4. The projectile according to claim 1, characterized in that the recesses are arranged on four circles which encompass the ogive and which are arranged at a right angle to the longitudinal axis of the projectile.

5. The projectile according to claim 1, further comprising peripheral grooves on the cylindrical region arranged beneath the recesses in the direction away from the projectile tip and running parallel to the circles.

6. The projectile according to claim 5, characterized in that the surface of the projectile tip is designed to be smooth and a calming zone whose surface is smooth is arranged beneath the recesses in the direction away from the projectile tip up to the grooves.

7. A use of a projectile claim 1 for cartridges of the caliber .22 LR, in particular for rim-fire cartridges.

8. The projectile according to claim 1, characterized in that each of the recesses has a tip that points in the direction of the projectile tip and a diameter that increases steadily from the tip up to the largest diameter and then decreases steadily from the largest diameter towards the rear cylindrical region, and in that the largest diameter is in a lower half of the droplet shape situated away from the projectile tip.

9. The projectile according to claim 8, characterized in that the projectile tip has a smooth surface.

10. A projectile, comprising:

a projectile tip at a front region of the projectile as seen in a direction of firing;

a rear cylindrical region;

an ogive region between the projectile tip and the rear cylindrical region in the shape of an ogive developing from the projectile tip to the rear cylindrical region;

a plurality of droplet shaped recesses provided on a surface of the ogive region, the recesses being arranged so they abut against one another on circles which encompass the ogive region and which are arranged at a right angle to a longitudinal axis of the projectile.

11. The projectile according to claim 10, wherein each of the recesses has a tip that points in a direction of the projectile tip and a diameter that increases steadily from the tip up to the largest diameter and then decreases steadily from the largest diameter towards the rear cylindrical region, and wherein the largest diameter is in a lower half of the droplet shape situated away from the projectile tip.

12. The projectile according to claim 11, wherein the projectile tip has a smooth surface.

13. The projectile according to claim 10, wherein the recesses on one circle are arranged with an offset from the recesses on a neighboring circle, so that a recess on one circle is arranged between two recesses on a neighboring circle.

14. The projectile according to claim 13, wherein the recesses are one circle are arranged with an offset from the recesses on the neighboring circle amounting to half of the diameter of a recess.

15. The projectile according to claim 14, wherein the recesses are arranged on four circles which encompass the ogive and which are arranged at a right angle to the longitudinal axis of the projectile.

16. The projectile according to claim 10, further comprising peripheral grooves on the cylindrical region arranged beneath the recesses in the direction away from the projectile tip and running parallel to the circles.

17. The projectile according to claim 16, wherein the projectile tip has a smooth surface and a calming zone whose surface is smooth is arranged beneath the recesses in the direction away from the projectile tip up to the grooves.

18. A .22 caliber LR cartridge comprising the projectile according to claim 10.

19. The .22 caliber LR cartridge according to claim 18, wherein the cartridge is a rim-fire cartridge.

* * * * *